United States Patent [19]

Matsui et al.

[11] Patent Number: 4,576,341

[45] Date of Patent: Mar. 18, 1986

[54] COP TRANSPORTING SYSTEMS FOR AN AUTOMATIC WINDER

[75] Inventors: Isamu Matsui, Kyoto; Hiroshi Uchida, Shiga; Kazuo Nakanishi, Uji; Masaharu Kiriake; Akira Shimano, both of Kyoto, all of Japan

[73] Assignee: Murata Kikai Kabushiki Kaisha, Japan

[21] Appl. No.: 472,156

[22] Filed: Mar. 4, 1983

[30] Foreign Application Priority Data

| | | | |
|---|---|---|---|
| Mar. 8, 1982 | [JP] | Japan | 57-36197 |
| Apr. 15, 1982 | [JP] | Japan | 57-63078 |
| Jul. 19, 1982 | [JP] | Japan | 57-12654 |

[51] Int. Cl.[4] ..... B65H 67/06

[52] U.S. Cl. ..... 242/35.5 A

[58] Field of Search ..... 242/35.5 A, 35.5 R, 242/35.6 R, 35.6 E

[56] References Cited

U.S. PATENT DOCUMENTS

| | | | |
|---|---|---|---|
| 3,154,904 | 11/1964 | Furst | 242/35.5 R X |
| 3,195,298 | 7/1965 | Furst | 242/35.5 R X |
| 3,224,694 | 12/1965 | Oishi | 242/35.5 R |
| 3,358,940 | 12/1967 | Beckwith, Jr. et al. | 242/35.5 R |
| 3,381,908 | 5/1968 | Igushi et al. | 242/35.5 R |
| 3,471,101 | 10/1969 | Moyer et al. | 242/35.6 R |
| 3,474,975 | 10/1969 | Brouwer et al. | 242/35.5 R |
| 3,480,128 | 11/1969 | Brouwer et al. | 242/35.5 R X |
| 3,480,216 | 11/1969 | Iannucci et al. | 242/35.6 R |
| 3,506,209 | 4/1970 | Matsui et al. | 242/35.5 R |
| 3,544,018 | 12/1970 | Stoppard et al. | 242/35.6 R |
| 3,563,479 | 2/1971 | Brouwer et al. | 242/35.5 R |
| 3,608,293 | 9/1971 | Brouwer | 242/35.6 R X |
| 3,727,852 | 4/1973 | Nelson et al. | 242/35.6 R |
| 3,774,859 | 11/1973 | Brouwer et al. | 242/35.5 A X |
| 3,933,320 | 1/1976 | Tsurumi et al. | 242/35.5 R |
| 4,010,907 | 3/1977 | Nishiyama et al. | 242/35.5 R |

*Primary Examiner*—Stanley N. Gilreath

*Attorney, Agent, or Firm*—Spensley Horn Jubas & Lubitz

[57] ABSTRACT

A cop transporting system for an automatic winder in which a single automatic winder can wind a plurality of different kinds of yarn at a time. A winder including a number of winding units therein is divided into a plurality of sections each including a plurality of winding units therein as a group, each of the sections having a specific cop supplying passage provided therein along the winding units. Each of the sections have a cop supply device provided therefor and cops fed out from the cop supply devices are transported to the specific supplying passage of the sections corresponding to the cop supply devices.

18 Claims, 19 Drawing Figures

COP TRANSPORTING SYSTEMS FOR AN AUTOMATIC WINDER

BACKGROUND OF THE INVENTION

This invention relates to a cop transporting system for an automatic winder, and more particularly to a system in which a single winder is supplied with and winds different kinds of yarns at a single time.

Cops of yarns wound up and doffed with a fine spinning frame are normally rewound with an automatic winder in order to remove defects of yarns, to obtain packages of a size and a configuration adapted for a succeeding process, and so on.

Such an automatic winder conventionally includes a number of spindle winding units. In each winding unit, a yarn is drawn from a cop by the unit and is taken up or wound on a package which is rotated by a driving drum. Each winding unit normally has a slub catcher for detecting and removing defects of yarns, a tension device, a waxing device and so on. Sometimes, either a knotter is mounted on each winding unit or a knotter travels across a plurality of winding units.

In any of such cases, a single automatic winder can rewind only one kind of cop yarns at one time thereon.

In order to rewind a plurality of kinds of cop yarns which are different in yarn count, color and the like, (a) a plurality of winders are installed on which a kind of yarns may be rewound, or else, (b) where a plurality of kinds of cop yarns are to be handled on a single winder, a different kind of yarns will be rewound after completion of rewinding of a particular kind of yarns. The former (a) is, in other words, of a space consuming type while the latter (b) is of a time consuming type.

However, both of these types are not very productive where a number of different kinds of cop yarns are to be rewound in small quantity.

SUMMARY OF THE INVENTION

The present invention has been made to overcome such defects of conventional automatic winders as described above.

An object of the present invention is to provide a system in which a single automatic winder can wind a plurality of different kinds of yarn at one time.

More particularly, the present invention provides a system wherein a single winder including a number of winding units therein is substantially divided into a plurality of sections each including a plurality of said winding units therein as a group, each of said sections having a specific cop supplying passage provided therein, each of said sections further having a cop supply device provided therefor, whereby cops fed out from said cop supply devices are transported to the specific supplying passages of the sections corresponding to said cop supply devices thereby to enable different kinds of cop yarns to be wound at one time with the single winder.

DETAILED DESCRIPTION OF THE INVENTION

In the following, systems embodying the present invention will be described in detail with reference to the accompanying drawings.

Figure 1:
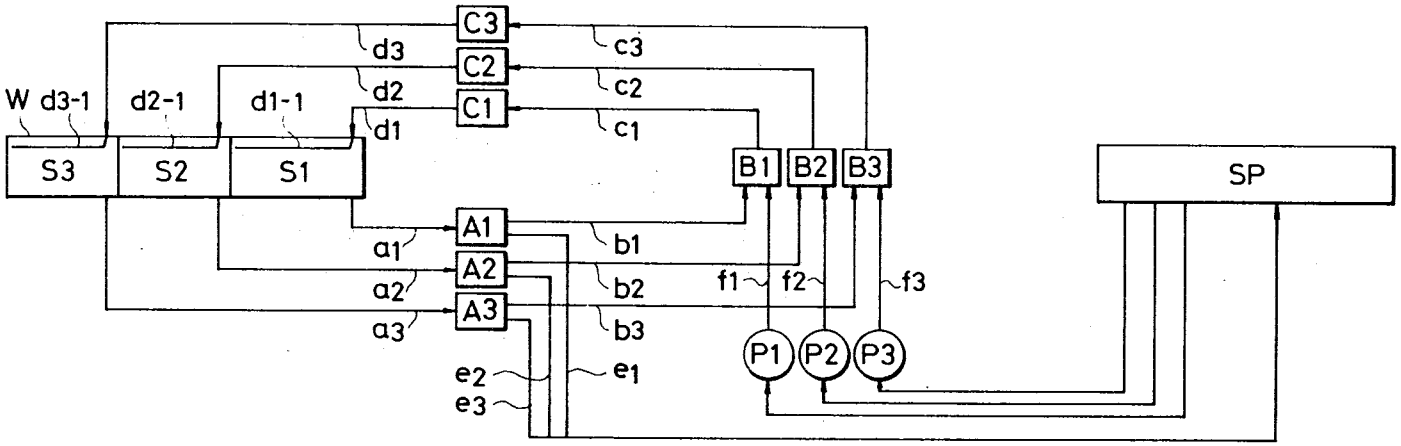
FIG. 1 is a diagrammatic representation of a first embodiment of the present invention.
Figure 2:
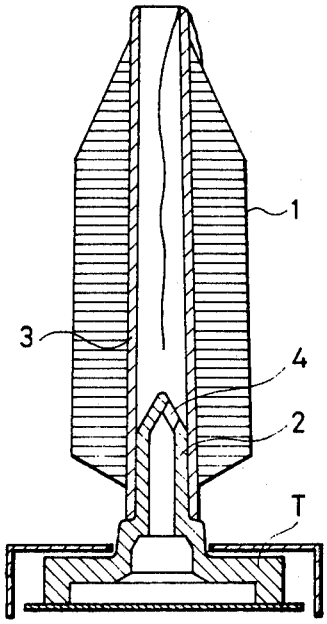
FIG. 2 is a sectional view showing a tray as a transporting medium for a cop in accordance with the invention.

Referring first to FIG. 1, there is illustrated, in a schematic representation, the layout of a first embodiment of the system of the invention. The system includes a winder, generally designated at W, which includes a number of winding units and is divided into three winding sections 51, 52 and 53. These winding sections 51, 52 and 53 each include a suitable number of spindles therein. For example, the winder W which has up to 60 spindles therein may consist of a first section 51 including up to 24 spindles for taking up a first kind X1 of yarns thereon, a second section 52 including up to 18 spindles for taking up a second kind X2 of yarns thereon, and so on. In the system, cops, empty bobbins and trays are mostly transported by a conveyor arrangement as will be hereinafter described, and flows or circulations of these are represented by arrow marks in FIG. 1. Referring now to FIG. 2, there is illustrated a cop which is being transported on such a conveyor arrangement. The cop, designated at 1, is uprightly supported on a hollow disk-formed tray T with a wooden bobbin 3 thereof fitted on a peg 2 uprightly provided at the center of the tray T. An air hole 4 is formed in a portion adjacent the top end of the peg 2. Yarns of cops 1 are unwound therefrom at the sections 51, 52 or 53 and are reduced to empty bobbins which are discharged onto empty bobbin carrying out conveyors a1, a2 and a3 and are then transported to empty bobbin unloading devices A1, A2 and A3. The unloading devices A1, A2 and A3 thus remove the empty bobbins from the trays T, and the trays T are then fed to cop supply devices B1, B2 and B3 by means of tray feeding conveyors b1, b2 and b3 while the empty bobbins thus removed are transported to a fine spinning frame SP by means of empty bobbin feeding conveyors e1, e2 and e3. From the fine spinning frame SP, new doffed cops 1 are fed to and stored in part feeders P1, P2 and P3 from which they are suitably fed to the cop supply devices B1, B2 and B3 by means of cop feeding conveyors f1, f2 and f3. The cop supply devices B1, B2 and B3 mount a new cop 1 supplied from the fine spinning frame SP onto each of the trays T fed by the tray feeding conveyors b1, b2 and b3. The trays T with the new cops 1 are thus fed to devices C1, C2 and C3 known herein as cop yarn leading devices, by means of cop feeding conveyors c1, c2 and c3. The cop yarn leading devices C1, C2 and C3 capture a yarn end of each cop 1 and cause the yarn end to be suspended from and into the top end of the wooden bobbin 3 of the cop 1 so as to facilitate unwinding at each section S1, S2 and S3 of the winder W. The cops 1 on the trays T are thus transported to the sections S1, S2 and S3 by means of cop supplying conveyors d1, d2 and d3. Specific supply passages d1-1, d2-1 and d3-1 for cops 1 are provided along the winding units U for the respective sections and are connected one by one to the cop supply conveyors d1, d2 and d3. Accordingly, a loop is formed starting from the first section S1, passing the empty bobbin discharging conveyor a1, empty bobbin unloading device A1, tray feeding conveyor b1, cop supply device B1, cop feeding conveyor c1, cop yarn leading device C1 and cop supplying conveyor d1, and returning to the first section S1. Thus, empty bobbins, trays T and cops 1 travel or circulate along the loop. A similar loop is also formed for each of the remaining second and third sections S2 and S3, and these loops are formed as independent and specific loops. Thus, separate tray feeding passages to the cop supply devices B1, B2 and B3 and separate empty bobbin feeding passages to the fine spinning frame SP are provided from each of the sections 51, 52 and 53 while separate cop supplying passages to the sections 51, 52 and 53 are provided from the fine spinning frame SP. In consideration of the fact that the loops have a substantially similar construction as described above, following description will be given principally of the loop for the first section 51.

Figure 3:
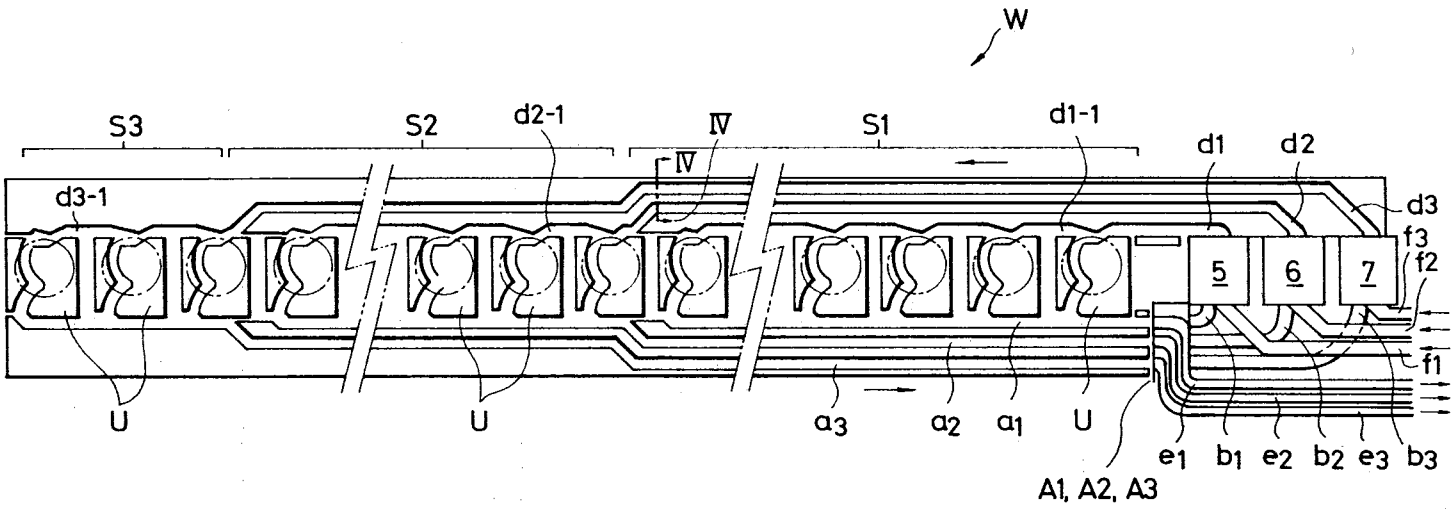
FIG. 3 is a view showing an arrangement of a winder of the first embodiment.

FIG. 3 represents the configuration of the automatic winder W. The winder W includes a number of winding units U disposed in a row and divided into three sections 51, 52 and 53. In these sections 51, 52 and 53, the cop supplying conveyors d1, d2 and d3 and the empty bobbin discharging conveyors a1, a2 and a3 extend and travel across the winding units U thereof. Portions of the cop supplying conveyors d1, d2 and d3 which are directly adjacent the units U are constituted as specific supplying passages d1-1, d2-1 and d3-1, respectively. Designated at 5, 6 and 7 are cop preparing devices, each including the cop supplying device B1, B2 or B3 and the cop yarn leading device C1, C2 or C3.

Figure 4:
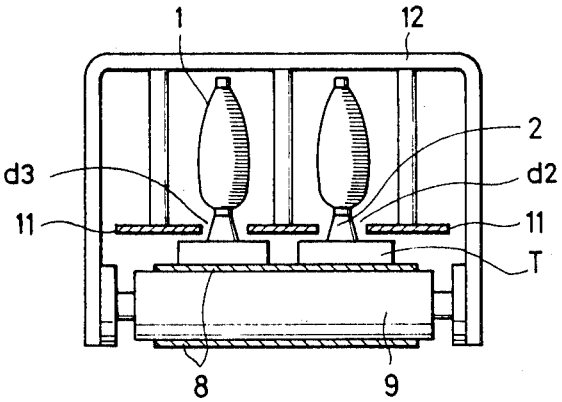
FIG. 4 is a sectional view taken along line IV—IV of FIG. 3.
Figure 5:
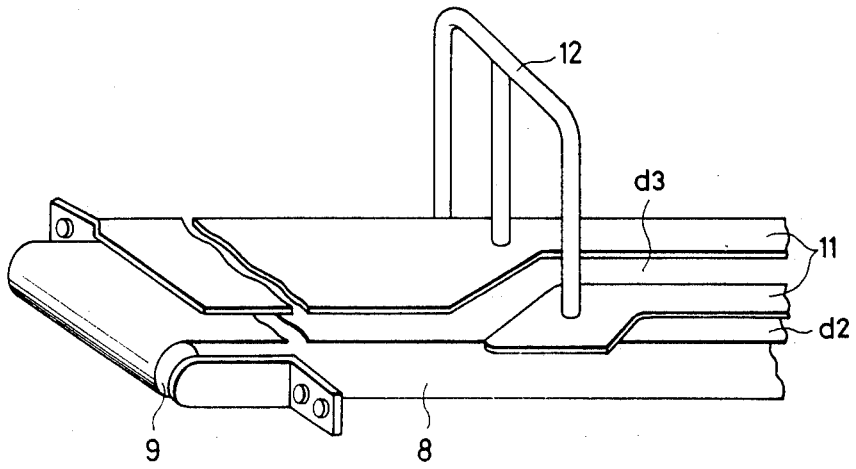
FIG. 5 is a perspective view of a portion of a conveyor shown in FIG. 3.

Description will now be given of the structure of the conveyors in the present system for transporting the cops 1, empty bobbins and trays T with reference to FIGS. 4 and 5. It is to be noted that, while these figures illustrate the cop supplying conveyors d2 and d3 extending to the second and third sections, the circumstances may be substantially similar to the remaining conveyors or where there are more than three conveyors. A belt conveyor 8, which may be of a conventional type, is disposed in front of and extends over the substantially whole length of a machine frame of the winder W and is supported on a suitable number of rollers 9. Guide plates 11 are supported above the belt conveyor 8 by means of a support bracket 12 and define therebetween guideways which are each sufficient to allow the peg 2 of the tray T to pass therethrough. The guideways thus provide the cop supplying conveyors d2 and d3.

Figure 6:
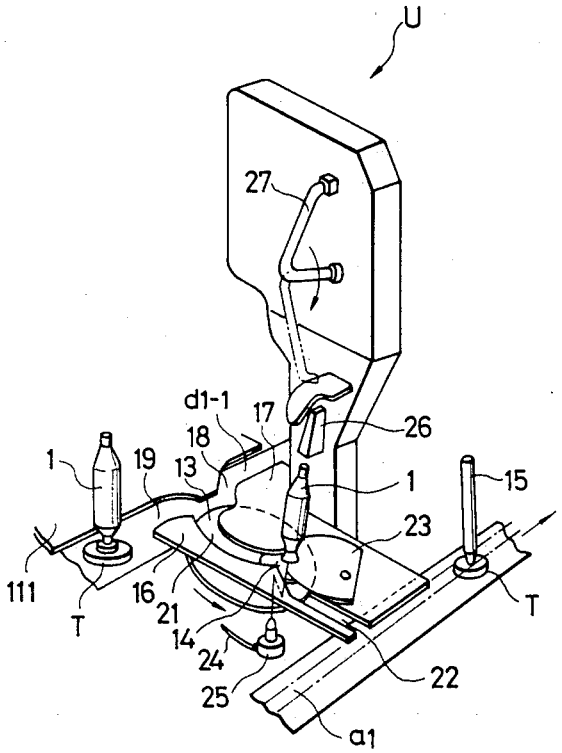
FIG. 6 is a perspective view showing a winding unit.

The winding unit U in the first section 51 will now be described with reference to FIG. 6.

The winding unit U includes a rotary disk 13 for transporting a cop 1 on the specific supplying passage d1-1 to an unwinding position 14 and for discharging an empty bobbin 15 to the empty bobbin discharging conveyor a1 after a yarn has been unwound from the cop 1 at the unwinding position. The disk 13 has a rather inclined face relative to the horizontal plane such that a portion thereof adjacent the individual supplying passage d1-1 is a little higher than a portion adjacent the empty bobbin discharging conveyor a1. Guide plates 16 and 17 are disposed in a fixed spaced relationship above the rotary disk 13. The guide plates 16 and 17 define, in cooperation with the aformentioned guide plates 11, a cop entrance 18 and a cop exit 19 while they define a cop stand-by guideway 21 and an empty bobbin discharging guideway 22 therebetween. The connecting point between the cop stand-by guideway 21 and the empty bobbin discharging guideway 22 provides the aforementioned unwinding position 14. A discharging lever 23 is also provided which discharges the empty bobbin after completion of such unwinding. An injection nozzle 25 is located below the tray T at the unwinding position 14 and may be connected to a compressed air source (not shown) by means of a duct 24. Thus, a cop 1 which has been transported along the individual supplying passage d1-1 is carried from the cop entrance 18 to the unwinding position 14 via the cop stand-by guideway 21 by the rotary disk 13. Then, compressed air is injected from the injection nozzle 25 towards the tray T at the unwinding position 14 whereupon the compressed air is admitted into the wooden bobbin 3 of the cop 1 through the air hole 4 of the tray T to blow up an end of the yarn hanging down in the wooden bobbin 3. Disposed above the unwinding position 14 are a balloon breaker 26, a relay pipe 27 for introducing an end of a cop to a knotter not shown, an unwinding package not shown, another relay pipe not shown for introducing an end of a yarn of the package, a yarn detecting device, and so on. Thus, the end of the yarn which is blown up as described above is tied with the end of the yarn of the unwinding package so that the yarn of the cop is unwound by the unwinding package. The cop is thus reduced to an empty bobbin 15 and is discharged via the empty bobbin discharging guideway 22.

Figure 7:
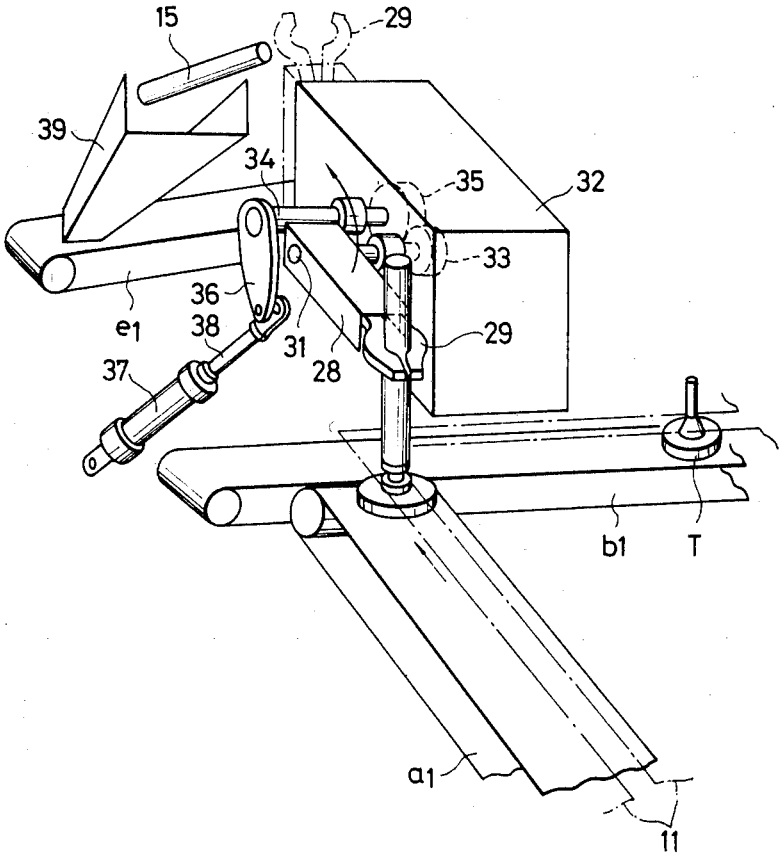
FIG. 7 is a perspective view showing an empty bobbin unloading device.

The empty bobbin unloading device A1 will now be described with reference to FIG. 7.

The empty bobbin unloading device A1 includes a whirling arm 28 which has at a free end thereof a chuck 29 for gripping an empty bobbin. The whirling arm 28 is supported on a body 32 by means of a shaft 31 to which a gear 33 is secured. The gear 33 is in meshed engagement with another gear 35 which is secured to an end of another shaft 34 extending in parallel relationship to the shaft 31. A rod 38 of an air cylinder 37 is connected to the shaft 34 by means of a crank arm 36. Thus, upon operation of the air cylinder 37, the whirling arm 28 is pivoted to allow the chuck 29 at the free end thereof to grip an empty bobbin 15 on the empty bobbin discharging conveyor a1. The air cylinder 37 further operates to cause the whirling arm 28 to unload the empty bobbin 15 from the tray T and then to throw the empty bobbin 15 into an empty bobbin guide 39. The empty bobbin 15 is then guided and transferred to the empty bobbin guide 39 onto the empty bobbin feeding conveyor e1 while the tray T from which the empty bobbin 15 has been removed is transferred onto the tray feeding conveyor b1.

Figure 8:
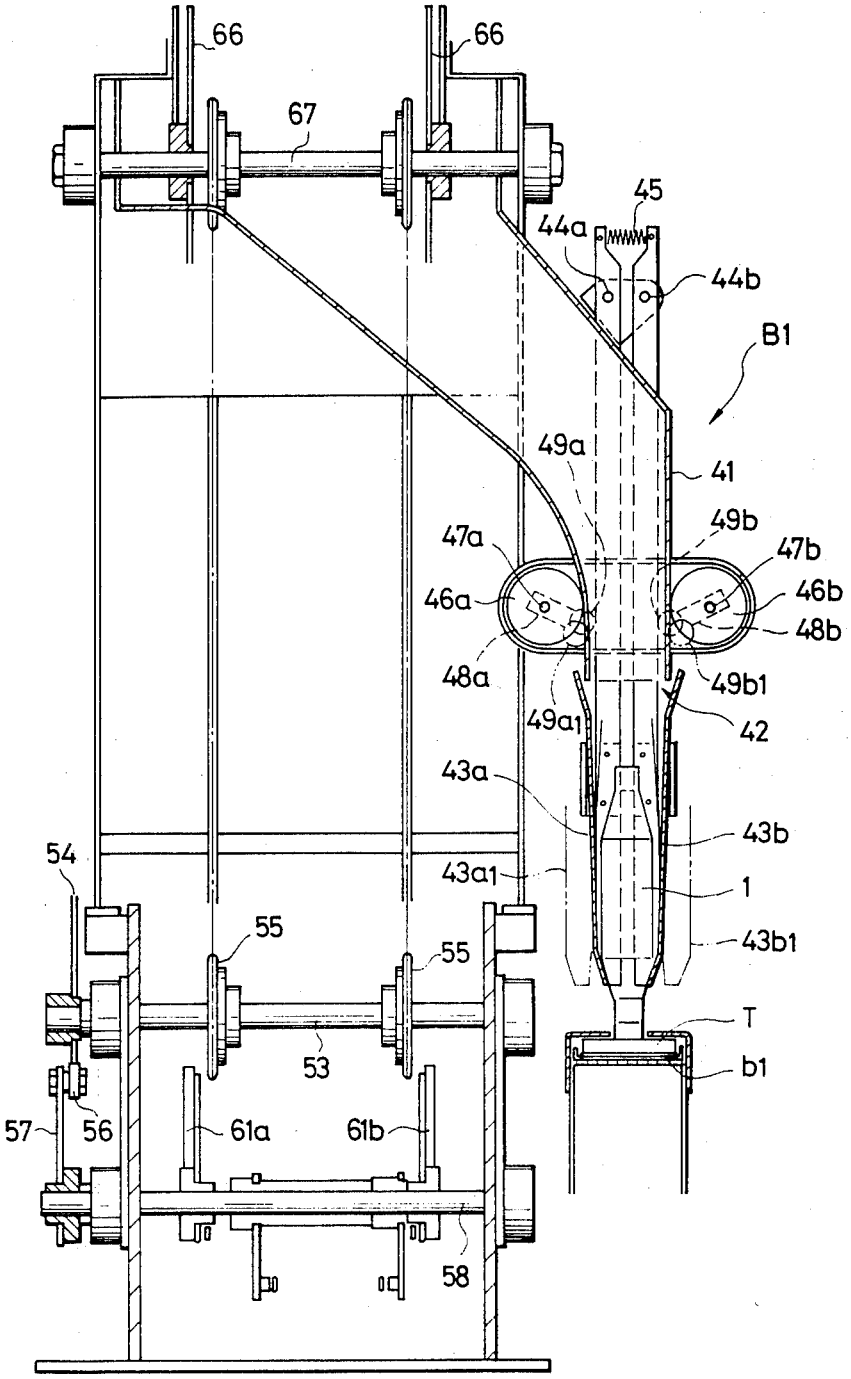
FIG. 8 is a side elevational view in longitudinal section of a cop supply device.
Figure 9:
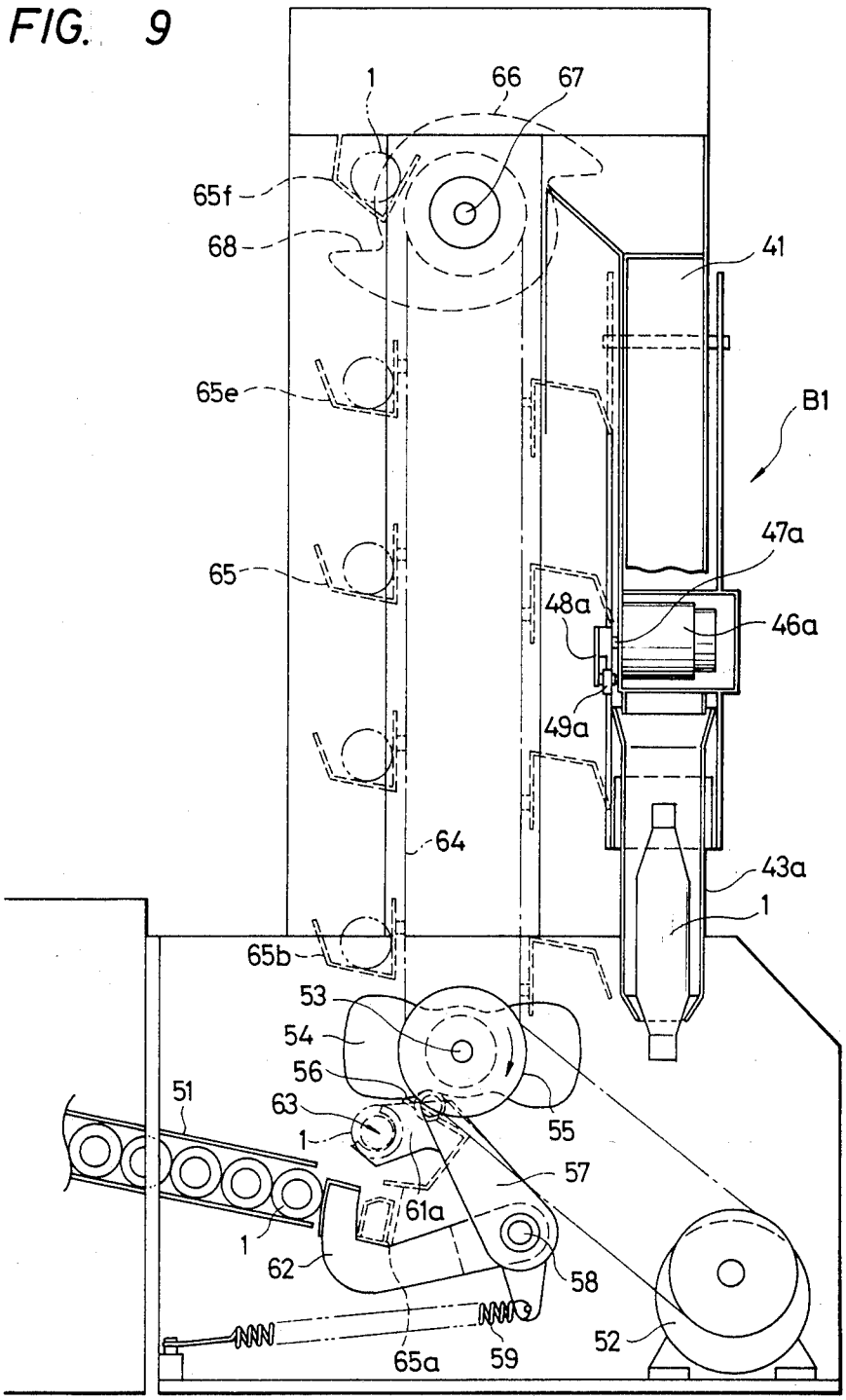
FIG. 9 is a front elevational view in longitudinal section of the cop supply device.

The cop supplying device B1 will now be described with reference to FIGS. 8 and 9.

The cop supplying device B1 includes a cylindrical chute 41. Cop guides 43*a* and 43*b* are located below an opening 42 formed at the bottom end of the chute 41. The cop guides 43*a* and 43*b* are mounted at their upper end portions for pivots motion around pivotes 44*a* and 44*b*, respectively, and are urged by a spring 45 in a direction to move or open lower ends thereof away from each other. Thus, both cop guides 43*a* and 43*b* can be rocked open and closed between respective two dots and dash line positions 43*a*1, 43*b*1 and the full line positions in FIG. 8. Rollers 49*a* and 49*b* are abutted against side faces of the cop guides 43*a* and 43*b*, respectively. The rollers 49*a*, 49*b* are mounted on end portions of levers 48*a* and 48*b* which are secured to stems 47*a* and 47*b* of rotary solenoids 46*a* and 46*b* for operation of the cop guides 43*a* and 43*b*, respectively. Thus, when a cop 1 is thrown into the chute 41, the rotary solenoids 46*a*, 46*b* operate to move the rollers 49*a*, 49*b* from the two dots and dash line positions 49*a*1, 49*b*1 to the full line positions, respectively, so that the cop guides 43*a*, 43*b* are brought to positions as represented by full lines, respectively. The cop guides 43*a*, 43*b* have a substantially channel-shaped horizontal cross section and are moved open or closed in a direction transverse to the direction of advancement of trays T below. Thus, a tray T which has been transported on the tray feeding conveyor b1 is once stopped in position just below the cop guides 43*a*, 43*b* by means of a stopper device not shown. Then, the rotary solenoids 46*a*, 46*b* are rendered operative and a cop loading device is also brought into operation to allow a new cop 1 to be dropped into the chute 41 so that the new cop 1 is fitted in position on the peg 2 of a tray T in its stand-by position below. Due to operation of a timer not shown, the rotary solenoids 46*a*, 46*b* are switched off after lapse of a predetermined fixed period of time to move open the cop guides 43*a*, 43*b* and at the same time, the stopper for trays is released so that the tray T which has the new cop 1 mounted thereon is transported to the cop yarn leading device C1 by the cop feeding conveyor c1.

The cop yarn loading device which constitutes part of the cop supplying device B1 will now be described. A cop 1 which has been fed in from the part feeder P1 as shown in FIG. 1 is thrown into the chute 41 by the cop yarn loading device. In particular, cops 1 which have been fed in from the part feeder P1 are stored in a row in the same orientation in an inclined cop storage 51 as seen in FIG. 9, and one of the cops 1 is released each time a motor 52 is energized in response to a predetermined signal to drive a shaft 53 to rotate an angle of 180 degrees about its axis. In practice, a cam 54 and a sprocket wheel 55 are integrally secured to the shaft 53, and upon rotation of the shaft 53, the cam 54 thereon operates a cam follower 56 to pivot a lever 57 a predetermined angle in a counterclockwise direction about an axis of another shaft 58 against the urging of a spring 59. Cop receiving plates 61*a* and 61*b*, which are integrally secured to the shaft 58, thereupon push down a stop lever 62 and come to a position adjacent an opening of the cop storage 51 so that a forwardmost first cop 1 is admitted and received in recesses 63 formed in the cop receiving plates 61*a*, 61*b*. It is to be noted that the cop receiving plates 61*a*, 61*b* are provided in paired spaced relationship on the shaft 58 as seen in FIG. 8 and support opposite ends of the cop 1. Then, as the cam 54 further rotates, the lever 57 returns to its original position and the cop receiving plates 61*a*, 61*b* also return to their initial positions as shown in FIG. 9 to make preparation for request for a subsequent next cop. In the meantime, the sprocket wheel 55 is also rotated an angle of 180 degrees in synchronism with rotation of the cam 54, whereupon a lowermost one of cop receiving members 65 secured in a uniformly spaced relationship to a chain 64 engages with a layer of and picks up the cop 1 supported on the cop receiving plates 61*a*, 61*b* and comes to a position 65*b* while another cop receiving member 65*a* which has been in a position 65*e* comes to another position 65*f*. At the same time, a releasing plate 66 at the top of the cop supplying device B1 is rotated an angle of 180 degrees about a shaft 67 to engage at a supporting portion 68 thereof with opposite ends of and pick up a cop 1 which has been in the position 65*f* in order to cause the cop 1 to be dropped into the chute 41.

Figure 10:
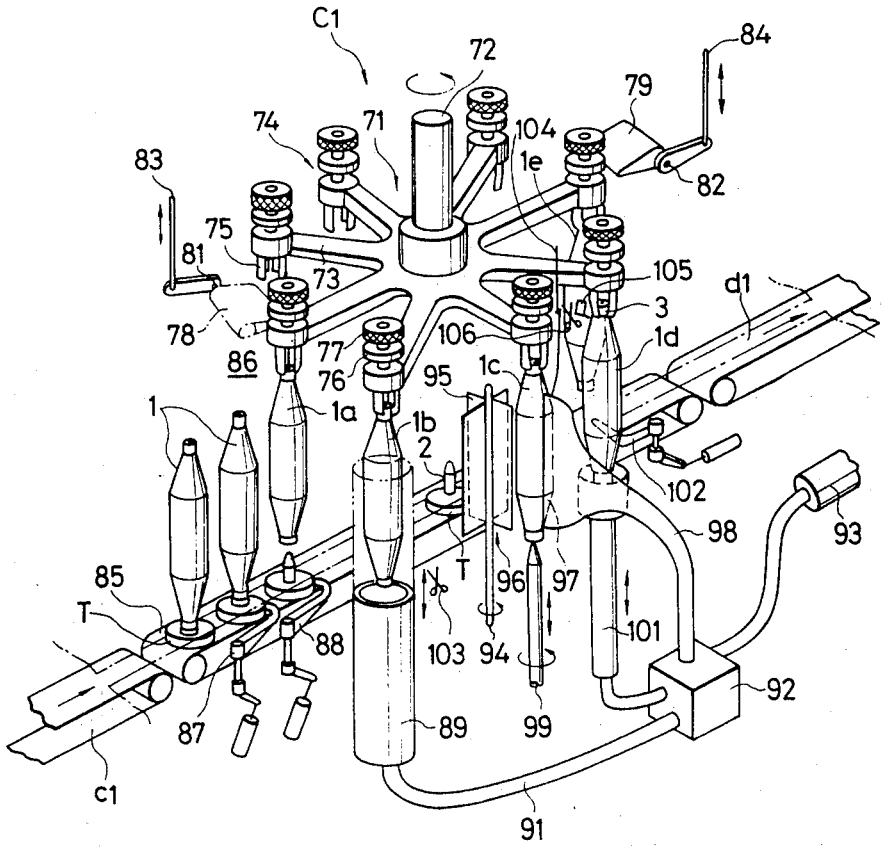
FIG. 10 is a perspective view of a cop yarn leading device.

Description will be given now of device C1, known herein as the cop yarn leading device C1, with reference to FIG. 10.

The cop yarn leading device C1 includes a cop hanger device 71 which has a plurality of cop hanging arms 73 extending radially from an intermittently rotating shaft 72 and a cop gripper 74 provided at an end of each of the cop hanging arms 73. The cop gripper 74 has a pair of fingers 75 depending therefrom and urged in a direction for engagement with each other at their respective ends. The cop gripper 74 further has a dish-formed member 76 mounted thereon for engagement with the opposite top ends of the fingers 75 such that, if the dish-formed member 76 is depressed against the urging of a spring not shown, the fingers 75 are pushed down thereby and open the lower ends thereof. Further, a pulley 77 is mounted above the dish-formed member 76 such that rotation thereof will rotate the fingers 75 about a common axis. Rocking plates 78 and 79 are supported on shafts 81 and 82, respectively, which are connected to rods 83 and 84, respectively, so that, if the rod 83 or 84 is axially moved up and down, the associated rocking plate 78 or 79 is rocked by the shaft 81 or 82. Each of the rocking plates 78, 79 has an end disposed for engagement with the dish-formed member 76 such that rocking motion thereof will push down the dish-formed member 76 to push open the associated fingers 75. Located below the cop hanger device 71 is an auxiliary conveyor 85 which interconnects the cop feeding conveyor c1 and the cop supplying conveyor d1. Stopper members 87 and 88 are provided for stopping a cop 1 at a position below a cop gripper 74 which is currently positioned at a cop chucking position 86 of the cop hanger device 71. Since the cop hanger device 71 shown in FIG. 10 has up to eight cop hanging arms 73, the intermittently rotating shaft 72 is designed to rotate by an angle of 45 degrees, and in this connection, a yarn trailing end sucking pipe 89 is disposed at a position below and spaced by an angle of 45 degrees of rotation from the cop chucking position 86. The yarn trailing end sucking pipe 89 is mounted for up and down movement, and when it is moved to a raised position, it surrounds a cop 1*b* supported by the cop hanger device 71. A conduit 91 is connected to the bottom end of the yarn trailing end sucking pipe 89 and connects to a filter box 92 which is in turn connected to a suction device not shown by means of a duct 93. Disposed below a position after movement of a cop gripper 74 by an angle of 90 degrees of rotation of the cop hanger device 71 from the cop cop chucking position 86 is an uprightly extending beater 96 which has a plurality of blades 95 provided around an upright rotary shaft 94. The beater 96 is disposed to have an end of one of the blades 95 slightly contacted with a surface of a layer of a yarn of a cop 1*c* gripped by a cop gripper 74. A yarn end sucking device 98 is also disposed adjacent the surface of the yarn layer of the cop 1*c* and has a suction opening 97 extending in a direction along the length of the cop 1*c*. The yarn end sucking device 98 is also connected to the filter box 92. Further, a cop supporting rod 99 is disposed for up and down movement just below the cop 1*c*, and when in a raised position, it is inserted in the wooden bobbin of the cop 1*c* and cooperates with the cop gripper 74 to support the wooden bobbin 3 of the cop 1*c* at opposite bottom and top ends thereof. In addition, below a position of the cop gripper 74 after rotation of an angle of 135 degrees from the chucking position 86, a yarn end sucking pipe 101 is located which is mounted for movement toward and away from a cop 1*d* in the axial direction. The yarn end sucking pipe 101 is connected to the suction duct 93 via the filter box 92 so that, when it is positioned adjacent the lower end of the cop 1*d*, the end of the yarn of the cop 1*d* may be sucked into the wooden bobbin 3 of the cop 1*d* from the top end thereof. Also, below a position of the cop gripper 74 after rotation of an angle of 180 degrees from the cop chucking position 86, a stopper 102 is provided which momentarily stops a tray T which has been fed thereto on the auxiliary conveyor 85. Between the yarn trailing end sucking pipe 89 and the cop supporting rod 99, a cutter 103 is provided for cutting the yarn end sucked in the yarn trailing end sucking pipe 89. A yarn guide 104 is also provided which engages with and draws up a yarn which extends between the yarn end section opening 97 and the cop 1*d* at the position after rotation of an angle of 135 degrees from the cop chucking position 86. When the yarn guide 104 is raised, the yarn is arrested by a feeler 105. Another cutter 106 is also provided which cuts the yarn between the yarn guide 104 and the feeler 105.

Operation of the cop yarn leading device C1 will be described in the following.

Cops 1 which have been transported on the cop feeding conveyor c1 are transferred to the auxiliary conveyor 85 and are fed thereon until they are stopped in order at the stand-by position by the stopper members 87, 88. The stand-by position defined by the stopper 88 corresponds to the cop chucking position 86. Then, the rod 83 located above the cop chucking position 86 is raised to cause the free end of the rocking plate 78 to be lowered thereby to push down the dish-formed member 76 to push open the fingers 75. As the rod 83 is lowered to cause the end of the rocking plate 78 to be raised, the fingers 75 clamp the top end of the cop 1*a* whereafter they are raised to draw up the cop 1*a* from the peg 2 of the tray T. Then, the intermittently rotating shaft 72 is rotated an angle of 45 degrees to carry the cop 1*a* to the next position of the cop 1*d*, and at the same time, the yarn trailing end sucking pipe 89 is raised and a trailing end of the yarn of the cop 1*b* is sucked into the pipe 89 whereafter the cutter 103 is rendered operative to cut off a predetermined length of the trailing end of the yarn. Then, the yarn trailing end sucking pipe 89 is lowered and the intermittently rotating shaft 72 is rotated a further angle of 45 degrees to carry the cop 1*b* to the position of the former cop 1*c*. The cop supporting pipe 99 is then inserted into the wooden bobbin of the cop 1*c* and rotates the cop 1*c* in the direction opposite to the winding direction of a layer of the cop while the beater 96 is simultaneously rotated to beat the surface of the yarn layer with the blades 95 thereof so that a yarn end of the cop 1*c* is separated from the yarn layer and is sucked into the suction opening 97 of the yarn end sucking device 98. Then, the cop supporting pipe 99 is lowered and the intermittently rotating shaft 72 is rotated a further angle of 45 degrees to carry the cop 1*c* to the position of the former cop 1*d* so that the end of the yarn of the cop 1*d* will extend between the cop 1*d* and the suction opening 97. In this position, the yarn guide 104 is raised to engage with and insert the end of the yarn into the feeler 105 which thus detects that intended guiding and disposition of the end of the yarn has been effected completely. At the same time, the yarn end sucking pipe 101 is raised to engage an upper end thereof with the bottom end of the cop 1*d* so as to effect sucking of the yarn end while the cutter 106 is operated to cut the end of the yarn. Consequently, the end of the yarn thus cut is sucked into the wooden bobbin of the cop 1*d* by the action of the yarn end sucking pipe 101 so that the yarn end will become suspended from the top end of the wooden bobbin as seen in FIG. 2. Meanwhile, a string of the yarn thus cut off is accumulated in the filter box 92. Subsequently, the yarn end sucking pipe 101 is lowered and the intermittently rotating shaft 72 is rotated a still another angle of 45 degrees. It is to be noted that the intermittently rotating shaft 72 has thus made rotation of a total angle of 180 degrees. Thus, the cop 1*e* is now positioned just above the tray T which is held stopped on the auxiliary conveyor 85 by the stopper 102. Then, the rod 84 is raised to cause the end of the rocking plate 79 to be lowered to lower the cop gripper 74 and then the fingers 75 are opened to allow the cop 1*e* to be fitted on the peg 2 of the tray T. The stopper 102 is thereafter released so that the tray T is transferred from the auxiliary conveyor 85 to the cop supplying conveyor d1 and is transported to the first section S1 of the winder W. It is to be noted that, if a yarn is not detected by the feeler 105 when the yarn guide 104 is raised, then an error the feeding of the yarn end into the bobbin is determined to have occur and after the cop is loaded on the tray T at the position 1*e*, it is fed, by a suitable means not shown, to a separately provided station where proper feeding of the yarn end is effected.

The system of the present invention has such a construction as described above, but it is to be noted that it is sometimes impossible to effect paper feeding of an end of a yarn of a cop 1 in the winding unit U of the winder W; in such a case, the cop 1 is discharged to the cop discharging conveyor a1 without having the yarn unwound therefrom. Thus, the cop unloading device A1 and the cop supplying device B1 have each provided thereon a sensor for detecting such a cop 1 from which a yarn has not been unwound. Thus, the cop 1 is allowed to pass by without being subject to any operation as described above until it reaches the yarn end leading device C1 where the above described operations are repeated to properly feed an end of the yarn thereon into the bobbin.

In the following, description will be given of another embodiment of the present invention.

Figure 11:
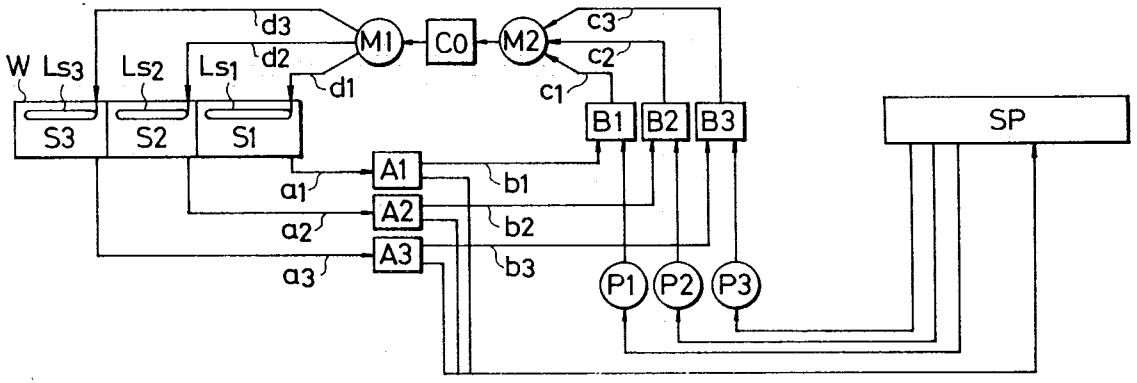
FIG. 11 is a diagrammatic representation showing a second embodiment of the invention.

FIG. 11 illustrates a second embodiment in contrast with the embodiment of FIG. 1. This system is made different from the system of FIG. 1 in that cops which have been transported by cop supplying conveyors d1, d2 and d3 are always circulating along cop loops Ls1, Ls2 and Ls3 provided in the respective sections S1, S2 and S3 and that multi-selectors M1 and M2 are disposed forwardly and rearwardly of a cop yarn leading device C0 so that different kinds of cops may be treated for leading with the single cop leading device C0.

Figure 12:
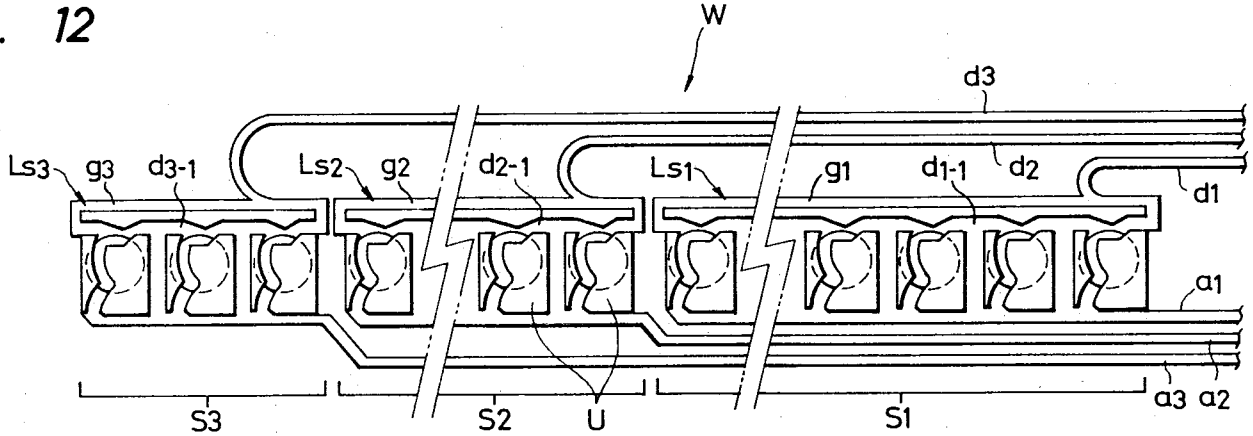
FIG. 12 is a view showing an arrangement of a winder of the second embodiment.

Now, reference is had to FIG. 12 to give description of such cop loops Ls1, Ls2 and Ls3.

Cop circulating conveyors g1, g2 and g3 are provided at connecting portions between the cop supplying conveyors d1, d2 and d3 and the sections S1, S2 and S3, respectively. The circulating conveyors g1, g2 and g3 are connected to opposite ends of the specific supply passages d1-1, d2-1 and d3-1 and run in the direction opposite to that of the specific supply passages d1-1, d2-1 and d3-1. Accordingly, surplus cops which have been supplied from the cop supplying conveyors d1, d2 and d3 to the respective sections S1, S2 and S3 are fed back from the last unit U to the first unit U of each section by the cop circulating conveyor g1, g2 or g3 in order to supply such surplus cops to the units U. Thus, even if there should appear a momentary imbalance between the cop unwinding capacity in each section S1, S2 and S3 and the cop supplying capacity of each cop supplying conveyor or d1, d2 and d3, such an imbalance is absorbed by this arrangement, thereby preventing deterioration of the activity rate of the winder W.

Figure 13:
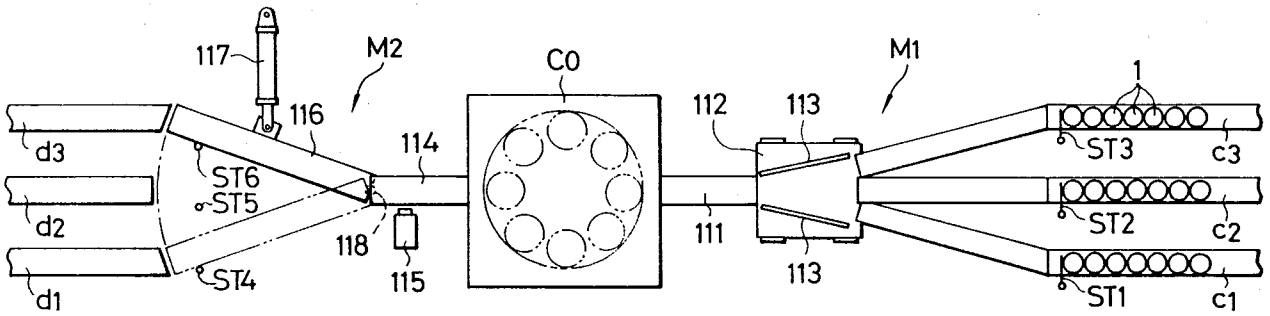
FIG. 13 is a diagrammatic representation showing a multi-selector.

Now, the multi-selectors M1 and M2 will be described with reference to FIG. 13. However, it must first be mentioned that, in using the multi-selectors M1 and M2 of the embodiment, different kinds of cops will be fitted on different kinds of trays, i.e., on different trays which can be distinguished with a photoelectric sensor or the like, such as, for example, differently colored trays. Also, it must be mentioned that a single device similar to those devices C1, C2 and C3 as illustrated in FIG. 10 is used for the cop yarn leading device C0 which is disposed between the multi-selectors M1 and M2.

The multi-selector M1 is provided for selectively supplying different kinds of cops 1 to the cop yarn leading device C0 and includes a single transporting conveyor 111 provided for a plurality of cop feeding conveyors c1, c2 and c3 which are provided independently for different kinds of cops 1. Movable stoppers ST1, ST2 and ST3 are disposed intermediate the respective cop feeding conveyors c1, c2 and c3 and the multi-selector M1. A selective one of the stoppers is released in accordance with a cop demanding signal from the winder W to allow a predetermined number of cops of a demanded kind to be fed to the cop yarn leading device C0. A suitable one of known detectors such as a photoelectric counter or the like may be employed for detection of the number of the cops. The multi-selector M1 further includes a conveyor 112 of a greater width and guide plates 113.

The other multi-selector M2 is provided for selectively directing cops 1, which have passed the cop yarn leading device C0 after the operating thereof placing the yarn end within the bobbin to the cop supplying conveyors d1, d2 and d3 which are specific for the respective kinds of cops. Commonly, there are various kinds of cops 1 which come out from the cop yarn leading device C0, but it is to be mentioned that, in the present embodiment, there are three kinds of cops. In the embodiment, the cops 1 of the various kinds are distinguished in accordance with colors of trays on a single transporting conveyor 111 by means of a sensor 115. A distributing conveyor 116 is turned about a shaft 118 by means of a drive source such as a hydraulic cylinder 117 or the like and stoppers ST4, ST5 and ST6 mounted for back and forth movement into and out of abutment with a side portion of the distributing conveyor 116 are selectively projected. For example, when a cop 1 which has passed the sensor 115 is to be fed to the cop supplying conveyor d1, only the stoppers ST4 is projected to allow the distributing conveyor 116 to be turned in the counterclockwise direction from a full line position until it is abutted against and stopped by the stopper ST4 thereby allowing the cop 1 to be transferred onto the cop supplying conveyor d1.

A third embodiment of the invention will be described in the followings.

Figure 14:
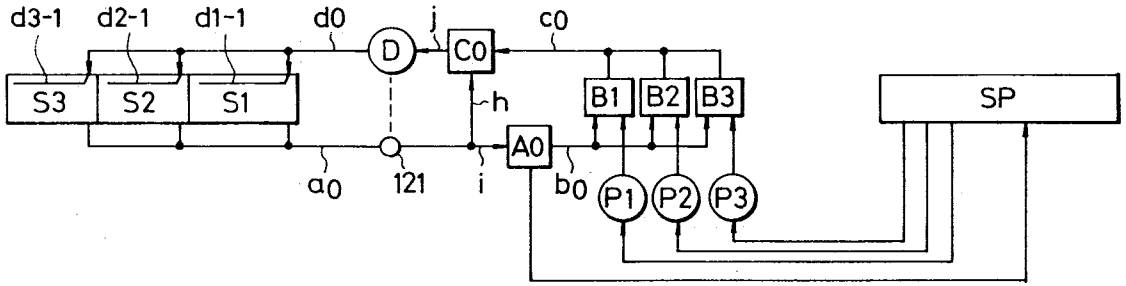
FIG. 14 is a diagrammatic representation showing a third embodiment of the invention.

FIG. 14 is a schematic representation of the third embodiment. This system is characterized, when compared with the preceding embodiments of the invention as illustrated in FIGS. 1 and 11, in that it includes a single cop supplying conveyor d0 which is branched into three that are connected to the sections S1, S2 and S3, respectively; that it includes also a single empty bobbing discharging conveyor a0; that it includes a single empty bobbin unloading device A0; that it includes, forwardly of the empty bobbin unloading device, a conveyor h extending from the empty bobbin discharging conveyor a0 to the cop yarn leading device C0 for feeding bobbins with yarns remaining thereon; that it includes a single cop feeding conveyor C0; and that it includes a single cop yarn leading device C0 and a cop storage device D disposed rearwardly of the cop yarn leading device C0. It also includes a counter unit 121 provided for controlling the storage device D.

In this embodiment, different kinds of cops are transported on trays of different colors, and such colors are detected by a predetermined sensor or sensors in order to enable the predetermined kinds of cops to be selectively delivered to the respective sections S1, S2 and S3. The cop supplying conveyor d0 is arranged commonly along all the sections S1, S2 and S3, and the cops are delivered to the sections by way of gates which are provided for individual sections.

Figure 15:
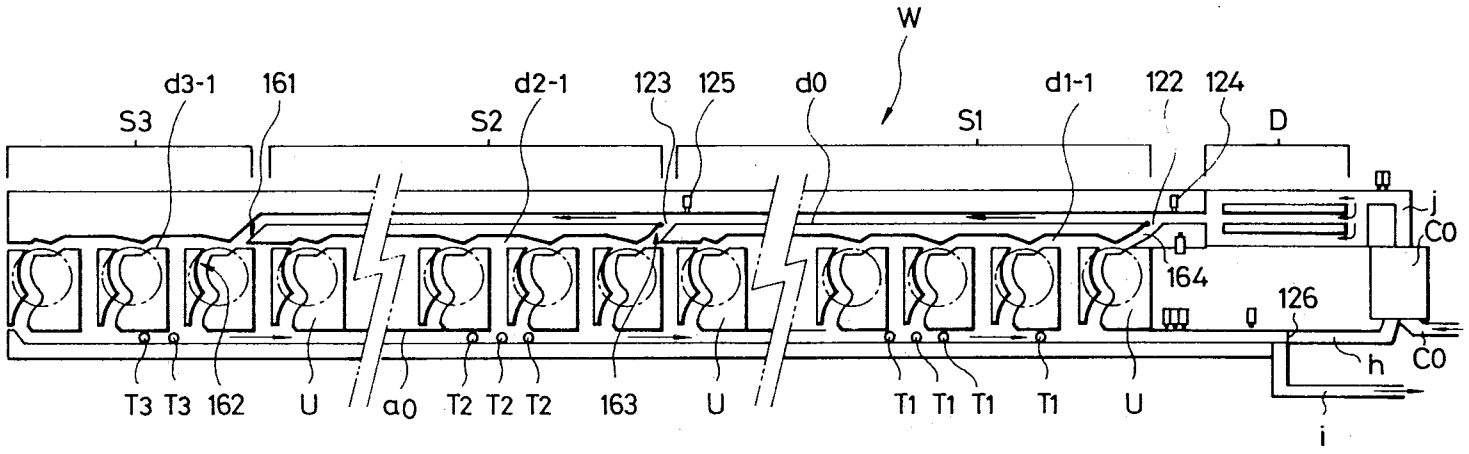
FIG. 15 is a view showing an arrangement of a winder of the third embodiment.

FIG. 15 illustrates an arrangement of the winder W of the present embodiment.

The winder W includes a cop supplying conveyor d0 which is common to the sections S1, S2 and S3, and specific supplying passages d1-1, d2-1 and d3-1 which are provided for individual sections and are branched from the cop supplying conveyor d0. Movable gates 122 and 123 are provided for the sections S1 and S2 and are operated to open and close in response to sensors 124 and 125 so that different cops 1 which have been transported thereto on the common cop supplying conveyor d0 may be selectively admitted into the respective sections S1, S2 and S3 for individual kinds thereof. The winder W has provided on the opposite side thereof a common empty bobbin discharging conveyor a0 for transporting different kinds of empty bobbins 15 which are discharged from the sections S1, S2 and S3. The empty bobbin discharging conveyor a0 is branched, by way of a movable gate 126, into two which include a bobbin feeding conveyor h for transporting bobbins with more than a predetermined amount of yarns remaining thereon to a cop yarn leading device C0, and an empty bobbin transporting conveyor i for feeding back empty bobbins to a fine spinning frame SP. In addition, the single cop yarn placing device C0 for leading ends of yarns of all of the cops 1 into their bobbins regardless of the kinds thereof, is disposed adjacent one end of the winder W. Further, a cop feeding conveyor c0 and a cop transporting conveyor j for delivering cops 1 after completion of leading of yarn ends thereof are connected to the cop yarn leading device C0. The cop yarn leading device C0 may be of the same construction as the cop yarn leading devices C1, C2 and C3 of the first embodiment or C0 of the second embodiment as described above. A cop storage device D for temporarily storing cops 1 after completion of the question of placing the yarn ends thereof within the bobbins is provided between the cop transporting conveyor j and the cop supplying conveyor d0.

Figure 16:
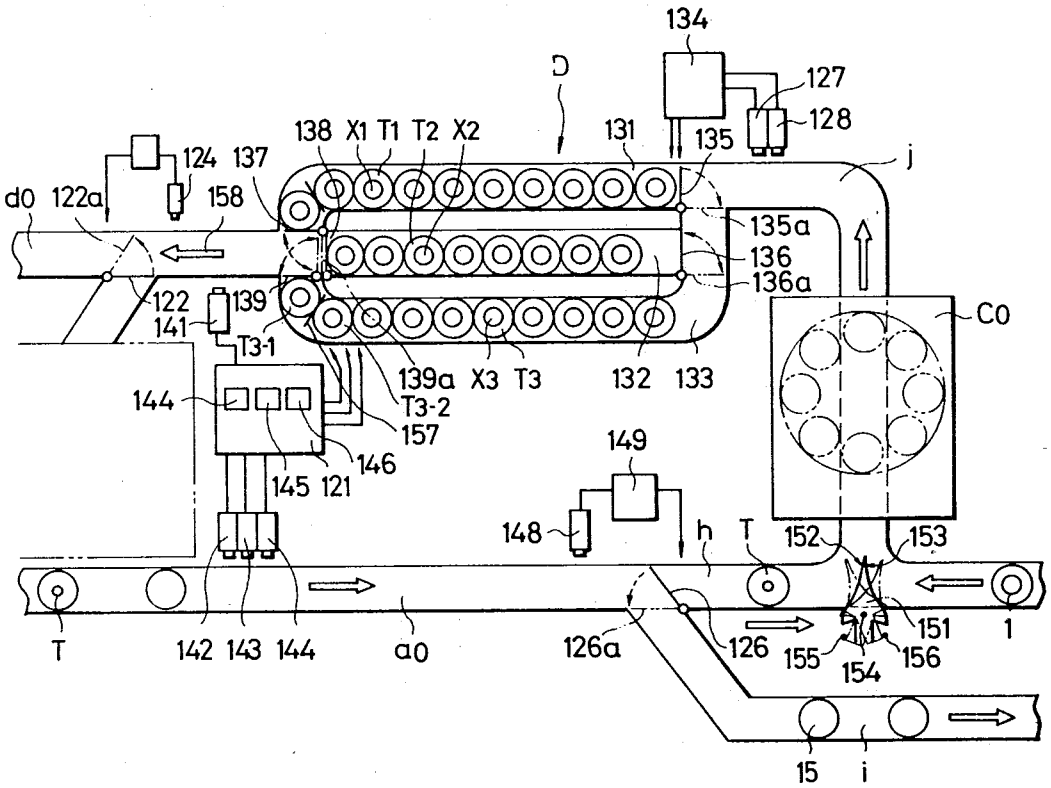
FIG. 16 is a diagrammatic representation showing a cop storage device.

FIG. 16 illustrates the cop storage device D. Assuming that up to three kinds of cops X1, X2 and X3 are fitted on trays T1, T2 and T3 of different kinds such as, for example, of the colors blue, black and white, the trays fed out from the cop yarn leading device C0 are distinguished by mark sensors 127 and 128 so that they may be selectively delivered into cop storing passages 131, 132 and 133 in accordance with the colors thereof. For example, if the blue trays T pass on the cop transporting conveyor j, only the mark sensor 127 for detection of blue trays is rendered operative and a movable gate 135 is turned from a full line position to a two dots and dash line position 135*a* under control of a controlling device 134 to allow the blue trays T1 to be automatically fed to the storage passage 131. On the other hand, in case of black trays T2, only the mark sensor 128 for detection of black trays is rendered operative and only a movable gate 136 is turned to a two dots and dash line position 136*a* so that the black trays T2 will be fed to the storage passage 132 since the movable gate 135 is in the full line position. Further gates 137, 138 and 139 are also provided which are opened and closed in accordance with control signals from the counter unit 121 and are normally in respective full line positions. Thus, one of the gates is opened in accordance with a predetermined cop supplying signal to allow a predetermined cop to be fed onto the cop supplying conveyor d0. A sensor 141 is provided for the cop supplying conveyor d0 for detecting the number of trays T which are being fed onto the conveyor d0, and a tray detection signal from the sensor 141 is coupled to the counter unit 121. Further, the movable gates 122 and 123 provided at the sections S1 and S2 adjacent the cop supplying conveyor d0 are turned, when the mark sensors 124 and 125 provided just before the gates 122 and 123 detect trays T of the predetermined colors, under control of a control section to cause the gates 122 and 123 to intercept the cop supplying conveyor d0; for example, only when the sensor 124 in FIG. 16 detects a blue tray T1, is the gate 122 is moved to its two dots and dash line position 122*a* so that the blue tray T1 which has been transported thereto will be fed to the specific supplying passage d1-1 of the first section S1. Disposed at a portion of the empty bobbin discharging conveyor a0 are further mark sensors 142, 143 and 144 for detecting the color and number of trays T which have been discharged from the winding units U and transported thereto, and the counter unit 121 for counting signals from these mark sensors. In the present embodiment, the sensor 142 is a photoelectric mark sensor provided for detection of blue trays T1, the sensor 143 is for black trays T2, and the sensor 144 is for white trays T3. Each of the sensors 142, 143 and 144 delivers a subtracting signal to the counter unit 121 each time a tray which can be distinguished thereby passes it, causing subtraction of graduations on a count display board 145, 146 or 147 for the individual color. After lapse of a predetermined period of time, a gate signal is delivered from the counter unit 121 in order to cause trays stored in the individual storage passage 131, 132 or 133 to be supplied to the cop supplying conveyor d0. Thus, trays of the same color and the same number corresponding to the reduction of the graduations will be supplemented. A remaining yarn detecting sensor 148 is also provided which may be a photoelectric sensor for detecting whether there still remains more than a predetermined amount of a yarn on a tray T which has been discharged from each of the winding units U. When there remains more than a predetermined amount of a yarn on a bobbin, such as, for example, a cop which was failed to have its yarn end properly disposed within its bobbins is detected at a winding unit U and has been discharged therefrom in such a condition, the sensor 148 senses such a remaining yarn thereby to render a controlling section 149 operative so that the gate 126 is turned from a full line position to a two dots and dash line position 126*a* and as a result the tray T on which the yarn remains is fed to the bobbin feeding conveyor h in order to feed the bobbin to the cop yarn leading device C0 again. In the mean time, an empty bobbin 15 with no yarn remaining thereon will allow the gate 126 to be held to the full line position so that the tray T for the empty bobbin 15 will be fed to the empty bobbin unloading device A0 via the empty bobbin transporting conveyor i. A guide 151 is provided which has curved guide faces 152 and 153 thereon and is mounted for rocking motion within a fixed limited range of angle about a fixed shaft 154. The guide 151 is rocked between a pair of stops 155 and 156 by a pressing force of a tray T in order to allow feeding to the cop yarn leading device C0 of trays T which have bobbins with remaining yarns thereon and trays T which have new cops 1 thereon.

Operations of the system of the present embodiment will be described in the following.

If, for example, four blue trays T1 are discharged from the first section S1, three black trays T2 are discharged from the second section S2 and two white trays T3 are discharged from the third section S3 in the direction of an arrow mark on the conveyor a0, they pass in front of the sensors 142, 143 and 144 shown in FIG. 16, although the order of the trays T1, T2 and T3 may be at random. Trays which support empty bobbins 15 thereon are discharged onto the empty bobbin transporting conveyor i while trays which support bobbins with yarns remaining thereon bring the remaining yarn detecting sensor 148 into operation so that the gate 126 is turned to the two dots and dash line position 126*a* thereby allowing the last-mentioned bobbins to be fed to the cop yarn leading device C0. When the trays pass in front of the sensors 142, 143 and 144, the sensor 142 only detects the number of the blue trays T1 and delivers a corresponding signal to the counter unit 121 so that the count of the count display board 144 is reduced by 4 from a preset value; similarly, the sensor 143 only detects the black trays T2 to thus reduce the count of the display board 145 by 3 while the sensor 144 detects the white trays T3 to reduce the count of the display board 146 by 2. Subsequently, a cop supplying signal is delivered to the cop storage device D from the counter unit 121. Thus, if, for example, a signal that trays T3 for cops X3 are to be supplied is provided at first, then the gate 139 for the cop storage passage 133 is moved to a chain line position 139*a* by a known means such as a relay, a solenoid or the like. As a result, only the first one T3-1 of the trays T3 is allowed to be fed out onto the cop supplying conveyor d0 and is then fed in the direction of an arrow mark 158. After the tray T3-1 has been fed out, the gate 139 is closed once and a stopper 157 may be either brought open or moved below the plane of the passage so that a next tray T3-2 is allowed to come to a position adjacent the gate 139. The gate 139 and the stopper may be correlated to each other. When the first tray T3-1 is fed in the direction of the arrow mark 158 and passes in front of the sensor 141, a signal representing that a tray has passed thereby is coupled to the counter unit 121 so that the count of the display board 146 for white trays increments by one. But, since the preset value is not yet reached, another cop supplying signal is provided to open the gate 139 again so that the next white tray T3-2 is fed out onto the cop supplying conveyor d0. The sensor 141 then detects passage of the tray thereby so that the count of the display board 146 for white trays T3 of the counter unit 121 is incremented by one and thus reaches the preset value, thereby completing supply of the required number of white trays T3. Subsequently, a signal for supply of black trays T2 is delivered from the counter unit 121 in a similar manner, and as a result, three black trays T2 are fed out onto the cop supplying conveyor d0 whereafter four blue trays T1 are fed out. Consequently, the cop supplying conveyor d0 is supplied with trays of the same kinds and in the same numbers with the trays T1, T2 and T3 which were discharged from the respective sections S1, S2 and Se of the winder W. These trays thus supplied are fed in the direction of the arrow mark 158 on the cop supplying conveyor d0. The sensors 124 and 125 provided adjacent the cop supplying conveyor d0 for each section are mark sensors which detect blue trays T1 and black trays T2, respectively, and accordingly, even when the white trays T3 pass in front of the sensor 124 or 125, the sensor is not rendered operative so that the gates 122, 123 remain in their respective positions as shown in FIG. 15 to thus allow the white trays T3 to be fed to an intake passage 161 for the third section S3. Then, the white trays T3 pass through the passage 161 and are delivered to the specific supplying passage d3-1 of the third section S3 whereafter they are fed to a waiting guideway 162 of those winding units U within the section S3 which discharged empty bobbins or bobbins with yarns remaining thereon. The succeeding black trays T2 are detected by the black tray detecting sensor 125 while they are being fed on the cop supplying conveyor d0 so that the gate 123 is turned to open an intake passage 163 for the second section S2, thereby allowing the three black trays T2 to be fed to the specific supplying passage d2-1 of the second section S2 and then be supplied to the required winding units U thereof. Also, the blue trays T1 are supplied from an intake passage 164 to required winding units U of the first section S1 in a similar manner. In this way, new trays T in the same number as the total number of the trays T which were discharged from the winder W are supplied to the winder W, and at the same time, new cops X1, X2 and X3 of the different kinds in the same numbers with those previously discharged are supplied to required winding units U. Thus, a single winder W can wind different kinds of yarns independently of one another.

Now, another embodiment for the empty bobbin unloading devices A0, A1, A2 and A3 of the systems described above will be described with reference to FIGS. 17, 18 and 19.

Figure 17:
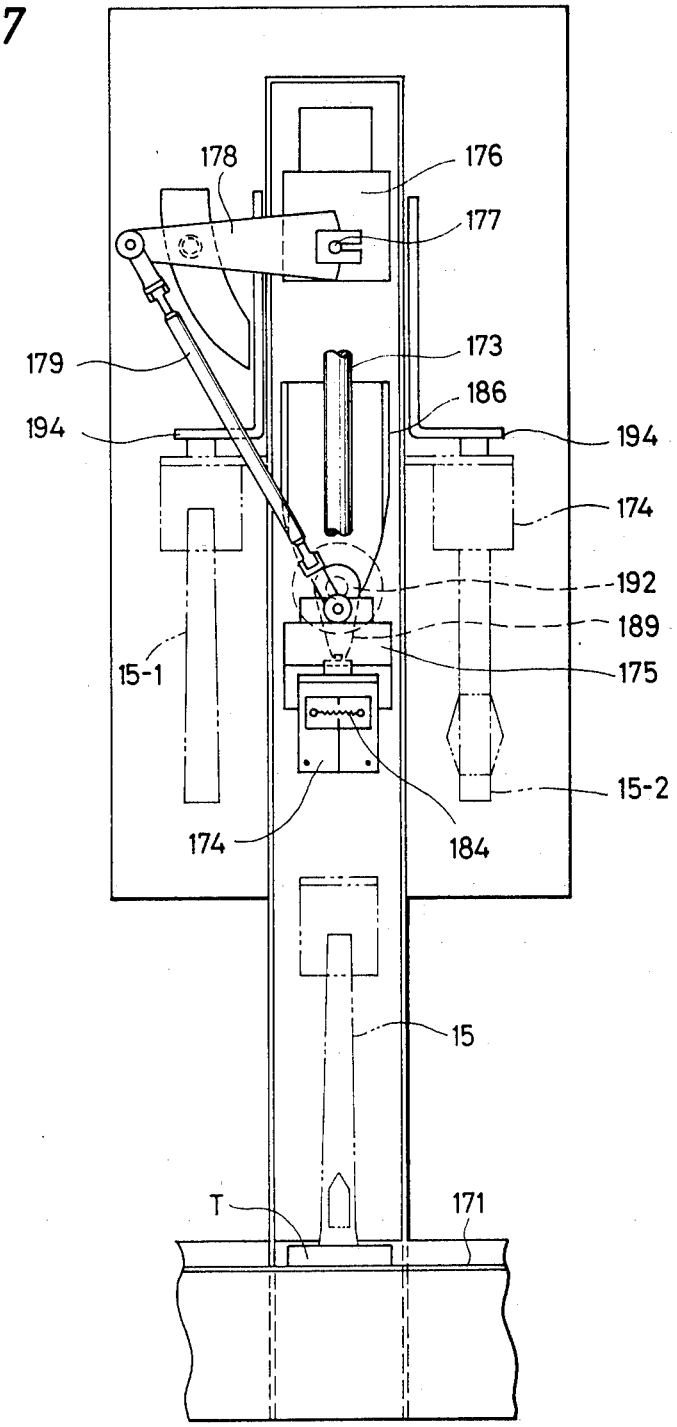
FIG. 17 is a front elevational view showing an empty bobbin unloading device in another form.
Figure 18:
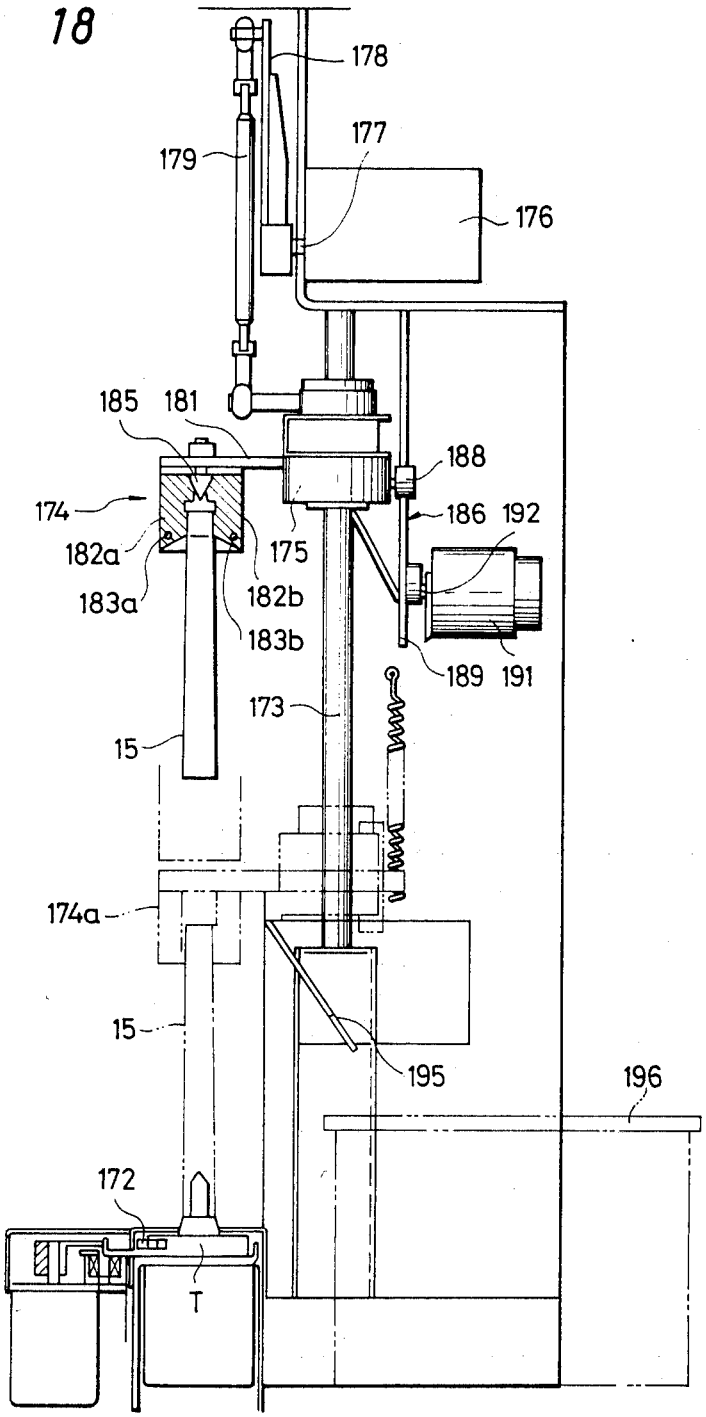
FIG. 18 is a side elevational view of the empty bobbin unloading device of FIG. 17.
Figure 19:
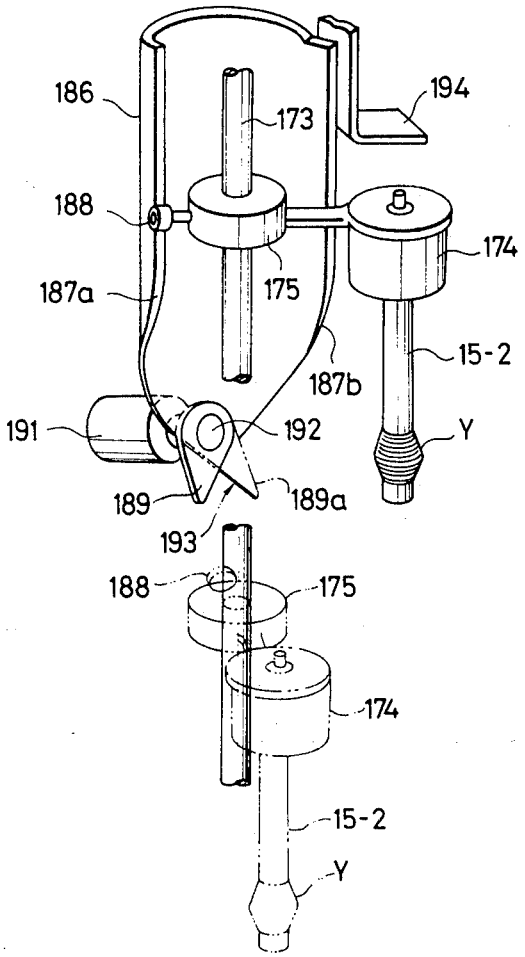
FIG. 19 is a perspective view showing essential part of the empty bobbin unloading device of FIG. 18.

The device of the present embodiment is designed such that those of empty bobbins 15 discharged from the units of the winder W which are determined to have less than a predetermined amount of a yarn left thereon may be further separated into a group of empty bobbins 15-1 which have no yarn Y remaining thereon and another group of bobbins which have a minimized amount or less than a predetermined amount of a yarn Y remaining thereon for separate storage of these different bobbins. In particular, an empty bobbin 15 is stopped by a movable stopper 172 at a fixed position on a conveyor 171 and is gripped and lifted by chuck 174 which is mounted for up and down movement along an upright guide shaft 173 relative to the empty bobbin 15 thus stopped whereafter it is released to drop from the chuck 174 at the top end of the guide shaft 173. The upright guide shaft 173 has a chuck supporting member 175 mounted for sliding motion therealong and also for rotation thereabout. The chuck supporting member 175 is moved up and down by means of a rod 179 which is connected to an end of a lever 178 secured to a shaft 177 of a rotary solenoid 176. Thus, when the lever 178 in FIG. 17 is rotated one revolution about an axis of the shaft 177, the chuck supporting member 175 is thereby reciprocated once in the vertical direction along the shaft 173. The chuck 174 is integrally supported by the supporting member 175 via a connecting plate 181 and includes a pair of fingers 182*a* and 182*b* each having formed at the center thereof a recess for receiving a bobbin therein as seen in FIG. 18. The fingers 182*a*, 182*b* are supported for pivotal motion on pins 183*a* and 183*b*, respectively, and are urged toward each other, that is, in a direction to hold a bobbin therebetween, by means of a spring 184 as shown in FIG. 17. A wedge-shaped member 185 is mounted for downward movement to push open the fingers 182*a*, 182*b* outwardly to allow an empty bobbin 15 held therebetween to be dropped therefrom. In this case, the empty bobbin 15 is classified as an empty bobbin 15-1 having no yarn left thereon and an almost empty bobbin 15-2 having a minimized amount of a yarn left thereon by means of a classifying guide 186 secured in the rear of the guide shaft 173. As shown in FIG. 19, the classifying guide 186 has a semicylindrical configuration which is cut obliquely relative to an axis thereof so that it presents a pair of guide end faces 187*a* and 187*b* which are diverged left and right from the shaft 173. Adjacent the bottom end of the classifying guide 186, a changeover member 189 of a substantially triangular shape is fixedly mounted on a shaft 192 of a rotary solenoid 191 in order to divert a guide roller 188 mounted on the chuck supporting member 175. Thus, the chuck 174 which has been moved down to a two dots and dash line position 174*a* in FIG. 18 and holds an empty bobbin 15 thereon is now moved up to a full line position. However, it is first determined by a photoelectric sensor whether the empty bobbin 15 held by the chuck supporting member 175 is an empty bobbin 15-1 having no yarn left thereon or an almost empty bobbin 15-2 having a minimized amount of a yarn left thereon, and the changeover member 189 is turned left or right in accordance with a signal representative of such determination. For example, in case of an empty bobbin 15-2 having a minimized amount of a yarn left thereon, the changeover member 189 is moved from a full line position to a two dots and dash line position 189*a* as seen in FIG. 19 so that, upon upward movement of the chuck supporting member 175, the guide roller 188 engages with the end face 193 of the changeover member 175. As the chuck supporting member 175 further moves upwardly, the guide roller 188 is guided by and along the guide end face 187*a* of the classifying guide 186. Accordingly, the chuck 174 is turned in the same direction and apparently it is moved in the opposite direction relative to the shaft 173 as it is moved upwardly. As the chuck 174 is moved up to a position in which the wedge-shaped member 185 of the chuck 174 is engaged at the top end thereof with the bottom face of a stop 194 located at the top end of the classifying guide 186, the wedge-shaped member 185 is pressed and moved down by the stop 194 relative to the chuck 174 thereby to push open the fingers 182*a*, 182*b* to allow the empty bobbin to be dropped therefrom. In FIG. 18, there is shown a chute 195 provided for guiding such an empty bobbin while dropping, whereby empty bobbins 15-1 having no yarn left thereon and almost empty bobbins 15-2 having a minimized amount of a yarn left thereon may be separately accommodated in a receiving box 196.

With the empty bobbin unloading device of the construction as described above, empty bobbins which have been determined on the recirculation path thereof that they cannot be fed again to the cop yarn leading device, that is, they have less than a predetermined amount of a yarn left thereon, can be further classified into empty bobbins 15-1 which have no yarn left thereon and almost empty bobbins 15-2 which have a small amount of a yarn left thereon. Accordingly, the former empty bobbins 15-1 may be fed back to the fine spinning frame SP while the latter almost empty bobbins 15-2 will be fed back to the fine spinning frame SP after removal of remaining yarns therefrom by some suitable means.

It is to be noted that, while the embodiments illustrated in the drawings and described above are designed such that three kinds of yarns can be wound with a single winder, a winder can be designed to wind two, four, five or more kinds of yarns. To this end, the number of sections, specific supplying passages and so on, may be decreased or increased in accordance with the number of such desired kinds of yarns.

As apparent from the foregoing description, a single winder according to the present invention can wind a plurality of kinds of yarns at one time, which facilitates a flexible application of the winder which is suitable for use in production of several kinds in small quantity.

We claim:

1. A cop transporting system for an automatic yarn winder including a number of winding units, comprising:

means for dividing said automatic winder into a plurality of sections, each section including a plurality of said winding units, each of said sections being adapted to wind a different type of yarn;

a plurality of cop supplying passages, in like number as the plurality of sections, each of said cop supplying passages being formed along said winding units so as to supply a differing section of the automatic winder;

a plurality of cop supply devices, in like number as the plurality of sections;

a plurality, in like number as the plurality of sections, of means for transporting cops fed out from said cop supply devices to the cop supply passages;

said plurality of means for transporting cops corresponding to said plurality of cop supply devices, to said plurality of cop supplying passages, and to said plurality of sections, in a specific one-to-one correspondence such that different kinds of yarns may be wound in the respective sections of the winder; and a plurality of hollow disk-formed trays for transporting cops, each of said trays including a hollow peg formed uprightly at the center of said tray, said pegs being adapted to removably fit within and support hollow wooden bobbins forming cores of said cops;

whereby said trays are transported on said means for transporting cops such that said bobbins are substantially vertically oriented.

2. A cop transporting system as claimed in claim 1, further comprising:

a plurality of empty bobbin discharging conveyors, in like number as said plurality of sections;

a plurality of empty bobbin unloading devices, in like number as said plurality of sections;

a plurality of tray feeding conveyors, in like number as said plurality of sections;

a plurality of cop feeding conveyors, in like number as said plurality of sections; and a plurality of devices for finding an end of a yarn on a cop and for positioning said end of yarn in said hollow bobbin of the cop, said plurality being in like number as said plurality of sections; and wherein each of said plurality of means for transporting said cops comprises a cop supplying conveyor;

said pluralities each being associated in a one-to-one correspondence such that a like plurality of loops are formed, a representative loop comprising the passage of a representative tray, containing an empty bobbin, starting from one of the winding units of one of the sections of the automatic winder, passing along the associated empty bobbin discharging conveyor to the associated empty bobbin unloading device, whereat the empty bobbin is removed from the tray, the tray then passing along the associated tray feeding conveyor to the associated cop supply device, whereat a cop on a bobbin, delivered to the cop supply device by the associated cop feeding conveyor, is mounted onto the tray, the combination then being provided to the associated device for finding an end of the yarn on the cop, whereat the yarn end is positioned within the hollow bobbin of the cop, the tray and cop then being transported by the associated cop supplying conveyor so as to return to the section of the automatic winder from whence the tray oriqinated, whereat the associated cop supplying passage delivers the tray and cop to one of the winding units of that section for performance of a winding operation, one of said loops being formed for each of the sections as an independent and specific loop.

3. A cop transporting system as claimed in claim 2, wherein said empty bobbin unloadind device comprises:

an arm having a free end thereof;

a chuck, adapted for gripping an empty bobbin, disposed at said free end of said arm;

a body of said empty bobbin unloading device, supporting said arm by a rotatable shaft;

driving means for rotating said shaft, arm and chuck between a first position at which an empty bobbin on one of said trays may be gripped by said chuck and removed from said tray, and a second position at which said empty bobbin removed from said tray may be released by said chuck; and means for actuating said chuck.

4. A cop transporting system as claimed in claim 2, wherein each of said plurality of devices for finding an end of a yarn on a cop and for positioning said end of yarn in said hollow bobbin of the cop comprises:

a rotatable, vertical shaft;

means for intermittently rotating said shaft about its vertical axis;

a cop hanger device, supported on, and rotating with, said shaft, said cop hanger device having a plurality of cop hanging arms extending radially from said shaft;

a plurality of cop grippers, disposed such that each of said plurality of cop hanging arms is provided with one of said cop grippers at an end thereof, each of said cop grippers having a pair of fingers mounted thereon and adapted to pivot about parallel axes;

means for controllably pivoting the fingers of each pair into mutual contact and separation;

means for conveying trays through said device;

means for stopping a cop at a position below the cop gripper;

a beater having a plurality of vertically-oriented blades disposed around a second vertical rotary shaft;

means for rotating said beater about its vertical axis in a manner adapted such that, during rotation of said beater, the radial ends of the blades make grazing contact with a surface of a cop gripped by the cop gripper of an appropriately disposed cop hanger arm; and a yarn end sucking device disposed adjacent to the surface of the gripped cop, and directed so as to capture said yarn end and place it within said hollow bobbin.

5. A cop transporting system as claimed in claim 1, wherein said cop supplying device comprises:

a substantially cylindrical, substantially vertically oriented chute, adapted to pass a cop therethrough in a longitudinal orientation;

a pair of spool guides located below an opening formed at the bottom end of said chute, said spool guides being mounted near their upper end portions for pivotal motion about parallel axes;

means, acting upon said spool guides, for urging said spool guides to pivot about said axes such that lower ends thereof are urged to separate;

rotary solenoid means for opening and closing the lower ends of the spool guides;

means for holding one of said trays approximately below the center of said spool guides; and means for placing a supplied cop into an uppermost end of the chute.

6. A cop transporting system as claimed in claim 1, further comprising a plurality, in like number as said plurality of sections, of devices for finding an end of a yarn on a cop and for positioning said yarn end in the hollow bobbin of the cop, a differing one of said devices being associated with each section of said automatic winder, disposed so as to be between its associated section and said section's associated cop supply device;

each of said devices comprising:

a rotatable vertical shaft;

means for intermittently rotating said shaft about its vertical axis;

a cop hanger device, supported on, and rotating with, said shaft, said cop hanger device having a plurality of cop hanging arms extending radially from said shaft;

a plurality of cop grippers, disposed such that each of said plurality of cop hanging arms is provided with one of said cop grippers at an end thereof, each of said cop grippers having a pair of fingers mounted thereon and adapted to pivot about parallel axes;

means for controllably pivoting the fingers of each pair into mutual contact and separation;

means for conveying trays through said device;

means for stopping a cop at a position below the cop gripper;

a beater having a plurality of vertically oriented blades disposed around a second vertical rotary shaft;

means for rotating said beater about its vertical axis in a manner adapted such that, during rotation of said beater, the radial ends of the blades make grazing contact with a surface of a cop gripped by the cop gripper of an appropriately disposed cop hanger arm; and a yarn end sucking device disposed adjacent to the surface of the gripped cop, and directed so as to capture said yarn end and place it within said hollow bobbin.

7. A cop transporting system for an automatic winder including a number of winding units, comprising:

means for dividing said automatic winder into a plurality of sections each including a plurality of said winding units;

a plurality, in like number as the plurality of said sections, of cop loops, each cop loop comprising a cop circulating conveyor, configured to provide each winding unit of its corresponding section with cops, such that surplus cops circulate around said cop loop until accepted by one of the winding units of said section;

a plurality, in like number as the plurality of said sections, of cop supplying conveyors, each being adapted to convey cops of a specific type to the cop circulating conveyor associated therewith;

a device for finding a loose yarn end of a cop and for locating said loose yarn end within the hollow bobbin supporting said cop;

means for selectively distributing cops supplied from said device for finding a loose yarn end of a cop and for locating said loose yarn end within the bobbin of said cop, by said specific types, to said plurality of cop supplying conveyors;

a plurality of, in like number as the plurality of said sections, of cop feeding conveyors, each of said conveyors providing cops of the specific type required by an associated one of said sections; and means for selectively supplying said device for finding a loose yarn end and for locating said yarn end within the hollow bobbin of its cop, by controlled quantities, with each specific type of cop from said cop feeding conveyors.

8. A cop transporting system as claimed in claim 7, wherein said means for selectively supplying said device for finding a loose yarn end of a cop and for locating said yarn within the hollow bobbin of its cop comprises:

a single transporting conveyor, adapted to accept cops from said plurality of cop feeding conveyors provided independently for different kinds of cops, each of said cop feeding conveyors being connected with the transporting conveyer; and movable stoppers disposed along each of the respective cop feeding conveyors so as to stop cops from leaving said copy feeding conveyors and entering onto said single transporting conveyor.

9. A cop transporting system as claimed in claim 8, wherein said means for selectively distributing cops supplied from said device for finding a loose yarn end of a cop and for locating said loose yarn and within the bobbin of said cop to said plurality of cop supplying conveyors comprises:

a single transporting conveyor;

a sensor, disposed at the side of the transporting conveyor, said sensor providing an output signal identifiably associated with each type of cop passing thereby;

a distributing conveyor, pivotably communicating with an output end of the transporting conveyor at an input end of the distributing conveyor, and selectively with input ends of the plurality of cop supplying conveyors at an output end of the distributing conveyor; and means for pivoting the distributing conveyor such that its output end is selectively communicated, in response to the output signal of the sensor, with one of the cop supplying conveyors.

10. A cop transporting system as claimed in any of the claims 7 to 9, further comprising:

a plurality of hollow disk-formed trays, each of said trays including a hollow peg formed uprightly at the center of said tray, said pegs being adapted to removably fit within and support hollow wooden bobbins forming cores of said cops;

whereby said trays may be transported by said conveyors such that said bobbins and cops are substantially vertically oriented, said different types of cops being fitted on different colored trays.

11. A cop transporting systems as claimed in claim 7, further comprising:

a plurality of trays, each adapted to carry a cop by supporting a bobbin on which said cop is wound, said trays being further adapted to be carried by and transferred between conveyors of the cop transporting system;

an empty bobbin unloading device disposed to accept empty bottoms carried by said trays transported from the winding units of the automatic winder; and wherein said empty bobbin unloading device comprises:

means for sensing the amount of yarn remaining on each bobbin, and for providing at least two signals corresponding to at least two predetermined amounts of yarn remaining on a bobbin;

means, responsive to one of said signals corresponding to a greater predetermined amount of yarn remaining on the bobbin, for diverting such bobbin so as to return it to a cop supplying portion of said cop transporting system; and means for removing empty bobbins having less than said greater predetermined amount of yarn from their corresponding trays and, in response to one of said signals corresponding to a lesser predetermined amount of yarn remaining on a bobbin, for directing such bobbin to an empty bobbin transporting conveyor when said signal is absent, and for diverting such bobbin to a separate storage area when said signal is present.

12. A cop transporting system for an automatic winder including a number of winding units, comprising:

means for dividing said number of winding units into a plurality of sections of said automatic winder, each including a plurality of said winding units;

a plurality, in like number as said plurality of sections, of cop supplying passages, one such passage formed for each section along said winding units thereof;

a single cop supplying conveyor;

a plurality, in like number as said plurality of sections, of conveyors communicating from said cop supplying conveyor to each section, respectively;

a single empty bobbin discharging conveyor, capable of accepting empty bobbins from each winding unit of each of said sections;

a single empty bobbin unloading device;

a single cop feeding conveyor, providing cops of a plurality of types from an external source;

a single device for finding a loose yarn end of a cop and for locating said loose yarn end within the bobbin of the cop;

a cop storage device, adapted to provide segregated storage areas for a plurality of cops of each type;

means for sensing the number of cops of each type discharged via said empty bobbin discharging conveyor;

means for segregating each type of cop into the appropriate one of the storage areas of the cop storage device;

means for directing a specific type of cop from said cop supplying conveyor to the appropriate one of said cop supplying passages through the appropriate one of said plurality of conveyors communicating therebetween; and a counter unit for controlling the release of cops of a specific type from said cop storage device;

said elements cooperating such that cops of all of said plurality of types of cops are provided by said cop feeding conveyor to said device for finding a loose yarn end of a cop and for locating said loose yarn end within the bobbin of the cop, from whence the cops are segregated into specific storage areas, by type, of said cop storage device, whereat they are retained until released by type under the control of said counter unit to proceed along said cop supplying conveyor, from which the cops of a specific type are controllably directed to the specific cop supplying passage of the section of the automatic winder adapted for winding cops of said specific type, whereat one of the plurality of winding units of said section performs a winding operation of said cops such that its empty bobbin is conveyed via said empty bobbin discharging conveyor past said means for sensing the number of cops of each type discharged, to said empty bobbin unloading device.

13. A cop transporting system as claimed in claim 12, further comprising:

a plurality of trays, each tray adapted to transport one of said cops, said trays being provided with different colors representing said different types of cops such that trays of a like color transport only cops of a like type; and wherein said means for directing a specific type of cop from said cop supplying conveyor to the appropriate one of said copy supplying passages associated with the respective sections, comprises:

a plurality of means for sensing the colors of each of said trays and for generating a signal unique to each such color; and gate means, responsive to said unique signals, for directing trays of a specific color into the appropriate cop supplying passage.

14. A cop transporting system as claimed in claim 13, further comprising:

means for sensing the amount of yarn remaining on a bobbin being transported by said empty bobbin discharging conveyor, said means providing an appropriate signal when the amount of yarn remaining on said bobbin exceeds a predetermined amount;

a bobbin feeding conveyor, communicating from said empty bobbin discharging conveyor to said device for finding a loose end of a cop and for locating said loose yarn end within the bottom of the cop;

an empty bobbin transporting conveyor, communicating from said empty bobbin discharging conveyor to a fine spinning frame; and means, responsive to said signal from said means for sensing the amount of yarn remaining on a bobbin, for directing bobbins having more than the predetermined amount of yarn remaining thereon to said bobbin feeding conveyor, and for directing all other bobbins to said empty bobbin transporting conveyor.

15. A cop transporting system as claimed in claim 14, wherein said cop storage device comprises:

a plurality of cop storing passages corresponding to said segregated storage areas, each said storing passage adapted to contain only cops of a specific type;

mark sensors for distinguishing the color of the colored means identifying each cop, said mark sensors providing unique signals for each color;

a cop transporting conveyor, adapted to convey cops of all types from said device for finding a loose yarn end of a cop and for locating said loose yarn end within a bobbin of the cop to said plurality of cop storing passages;

a first set of movable gates provided at the entrance to each of the cop storing passages from the cop transporting conveyor, respectively;

a controlling device, for operating said first set of movable gates in response to said signals from said mark sensors such that cops of only one specific type are enabled to be stored in each of said storing passages; and a second set of movable gates provided on the cop storing passages at the end thereof communicating with the cop supplying conveyor, said second set of movable gates being operated to be opened or closed in accordance with control signals from the counter unit.

16. A cop transporting system as claimed in claim 13 wherein said cop storage device comprises:

a plurality of cop storing passages corresponding to said segregated storage areas, each said storing passage adapted to contain only cops of a specific type;

mark sensors for distinguishing the color of the colored means identifying each cop, said marked sensors providing unique signals for each color;

a cop transporting conveyor, adapted to convey cops of all types from said device for finding a loose yarn end of a cop and for locating said loose yarn end within a bobbin of the cop to said plurality of cop storing passages;

a first set of movable gates provided at the entrance to each of the cop storing passages from the cop transporting conveyor, respectively;

a controlling device, for operating said first set of movable gates in response to said signals from said marked sensors such that cops of only one specific type are enabled to be stored in each of said storing passages; and a second set of movable gates provided on the cop storing passages at the end thereof communicating with the cop supplying conveyor, said second set of movable gates being operated to be opened or closed in accordance with control signals from the counter unit.

17. A cop transporting system as claimed in claim 13, wherein said cop storage device comprises:

a plurality of cop storing passages corresponding to said segregated storage areas, each said storing passage adapted to contain only trays bearing cops of a specific type;

mark sensors for distinguishing color of the colored means identifying each tray, said mark sensors providing unique signals for each color;

a cop transporting conveyor, adapted to convey trays bearing cops of all types from said device for finding a loose yarn end of a cop and for locating said loose yarn end within a bobbin of a cop to said plurality of cop storing passages;

a first set of movable gates provided at the entrance to each of the cop storing passages from the cop transporting conveyor, respectively;

a controlling device, for operating said first set of movable gates in response to said signals from said marked sensors such that trays bearing cops of only one specific type, identified by one specific color, are enabled to be stored in each of said storing passages; and a second set of movable gates provided on the cop storing passages at the end thereof communicating with the cop supplying conveyor, said second set of movable gates being operated to be opened or closed in accordance with control signals from the counter unit.

18. A cop transporting system as claimed in claim 12, further comprising:

a plurality of trays, each adapted to carry a cop by supporting a bobbin on which said cop is wound, said trays being further adapted to be carried by and transferred between conveyors of the cop transporting system; and wherein said empty bobbin unloading device comprises:

means for sensing the amount of yarn remaining on each bobbin, and for providing at least two signals corresponding two at least to predetermined amounts of yarn remaining on a bobbin;

means, responsive to one of said signals corresponding to a greater predetermined amount of yarn remaining on the bobbin, for diverting such bobbin, on its tray, so as to return to said cop feeding conveyor; and means for removing empty bobbins from their corresponding trays and, in response to one of said signals corresponding to a lesser predetermined amount of yarn remaining on the bobbin, for directing such bobbin to an empty bobbin transporting conveyor when said signal is absent, and for diverting such bobbin to a separate storage area when said signal is present.

* * * * *